US007650942B2

(12) United States Patent
Abbey et al.

(10) Patent No.: US 7,650,942 B2
(45) Date of Patent: Jan. 26, 2010

(54) SUB SEA CONTROL AND MONITORING SYSTEM

(75) Inventors: Stephen Trevor Abbey, Strensall (GB); William Paul Gentles, Pickering (GB)

(73) Assignee: Remote Marine Systems Limited, North Yorkshire (GB)

( * ) Notice: Subject to any disclaimer, the term of this patent is extended or adjusted under 35 U.S.C. 154(b) by 513 days.

(21) Appl. No.: 11/275,322

(22) Filed: Dec. 22, 2005

(65) Prior Publication Data

US 2006/0157250 A1 Jul. 20, 2006

(51) Int. Cl.
*E21B 29/12* (2006.01)
*E21B 43/00* (2006.01)
*H01R 4/60* (2006.01)

(52) U.S. Cl. ..... 166/338; 166/345; 166/65.1; 340/854.9; 439/310; 439/190

(58) Field of Classification Search ..... 166/336, 166/338, 337, 65.1, 66.4, 66, 250.1, 345; 702/6; 340/853.1, 854.9; 439/310, 190
See application file for complete search history.

(56) References Cited

U.S. PATENT DOCUMENTS 3,219,118 A * 11/1965 Lewis ..... 166/351
3,516,491 A * 6/1970 Lewis ..... 166/336
3,638,732 A * 2/1972 Huntsinger et al. ..... 166/379
3,656,549 A * 4/1972 Holbert et al. ..... 166/356
3,894,560 A * 7/1975 Baugh ..... 137/606
4,191,250 A * 3/1980 Messenger ..... 166/253.1
4,352,376 A * 10/1982 Norwood ..... 137/624.15
4,365,506 A * 12/1982 Hyde ..... 73/152.61
4,378,848 A * 4/1983 Milberger ..... 166/351
4,437,521 A * 3/1984 Richardson et al. ..... 166/341
4,491,176 A * 1/1985 Reed ..... 166/66.4
4,523,194 A * 6/1985 Hyde ..... 340/853.3
4,636,934 A * 1/1987 Schwendemann et al. ..... 700/3
4,736,799 A * 4/1988 Ahlstone ..... 166/348
4,791,990 A * 12/1988 Amani ..... 166/311
4,798,247 A * 1/1989 Deaton et al. ..... 166/66.7
4,804,045 A * 2/1989 Reed ..... 166/65.1
4,886,114 A * 12/1989 Perkins et al. ..... 166/66.7
4,901,798 A * 2/1990 Amani ..... 166/311
4,981,173 A * 1/1991 Perkins et al. ..... 166/66.7
5,006,044 A * 4/1991 Walker et al. ..... 417/12
5,006,046 A * 4/1991 Buckman et al. ..... 417/54
5,035,581 A * 7/1991 McGuire et al. ..... 417/36
5,063,775 A * 11/1991 Walker et al. ..... 73/152.31
5,209,673 A * 5/1993 Mohn et al. ..... 439/199
5,533,572 A * 7/1996 Brady et al. ..... 166/250.05

(Continued)

*Primary Examiner*—Thomas A Beach
(74) *Attorney, Agent, or Firm*—Banner & Witcoff Ltd.

(57) ABSTRACT

A system for monitoring and/or controlling at least one device mounted on a tubing string of a well, the system comprising: a down-well cable for conveying a signal to and/or from at least one device mounted on a tubing string of a well; a temporary surface cable for conveying a signal between the at least one device and a first monitor/control station prior to and/or during installation of a tubing string in a well; a permanent surface cable for conveying a signal between the at least one device and a second monitor/control station after installation of the tubing string in a well; and switch means configurable between a first configuration, in which the down-well cable and the temporary cable are connected, and a second configuration, in which the down-well cable and the permanent cable are connected.

16 Claims, 10 Drawing Sheets

U.S. PATENT DOCUMENTS 5,558,532 A * 9/1996 Hopper ..... 439/310
5,706,892 A * 1/1998 Aeschbacher et al. ..... 166/66
5,819,849 A * 10/1998 Booth ..... 166/252.1
5,831,156 A * 11/1998 Mullins ..... 73/152.18
5,941,307 A * 8/1999 Tubel ..... 166/313
5,955,666 A * 9/1999 Mullins ..... 73/152.18
6,068,053 A * 5/2000 Shaw ..... 166/267
6,109,352 A * 8/2000 Edwards et al. ..... 166/336
6,227,300 B1 * 5/2001 Cunningham et al. ..... 166/339
6,394,837 B1 * 5/2002 Edwards et al. ..... 439/426
6,484,806 B2 * 11/2002 Childers et al. ..... 166/351
6,494,266 B2 * 12/2002 Rogala et al. ..... 166/339
6,530,433 B2 * 3/2003 Smith et al. ..... 166/387
6,633,236 B2 * 10/2003 Vinegar et al. ..... 340/854.4
6,679,332 B2 * 1/2004 Vinegar et al. ..... 166/373
6,681,861 B2 * 1/2004 Davidson et al. ..... 166/382
6,840,316 B2 * 1/2005 Stegemeier et al. .... 166/250.12
6,873,267 B1 * 3/2005 Tubel et al. ..... 340/853.3
6,896,056 B2 * 5/2005 Mendez et al. ..... 166/254.2
6,991,035 B2 * 1/2006 Hall et al. ..... 166/301
7,147,059 B2 * 12/2006 Hirsch et al. ..... 166/372
7,165,620 B2 * 1/2007 Steedman ..... 166/368
7,395,866 B2 * 7/2008 Milberger et al. ..... 166/345
7,397,388 B2 * 7/2008 Huang et al. ..... 340/853.3
7,410,002 B2 * 8/2008 Khazanovich et al. ..... 166/382
7,552,762 B2 * 6/2009 Khazanovich et al. ... 166/75.14
2002/0007952 A1 * 1/2002 Vann ..... 166/369
2004/0134662 A1 * 7/2004 Chitwood et al. ..... 166/367
2005/0039923 A1 * 2/2005 Howe et al. ..... 166/368
2006/0213659 A1 * 9/2006 McCoy ..... 166/250.01
2006/0231263 A1 * 10/2006 Boyce et al. ..... 166/360
2006/0231264 A1 * 10/2006 Boyce et al. ..... 166/363
2008/0060846 A1 * 3/2008 Belcher et al. ..... 175/25

* cited by examiner

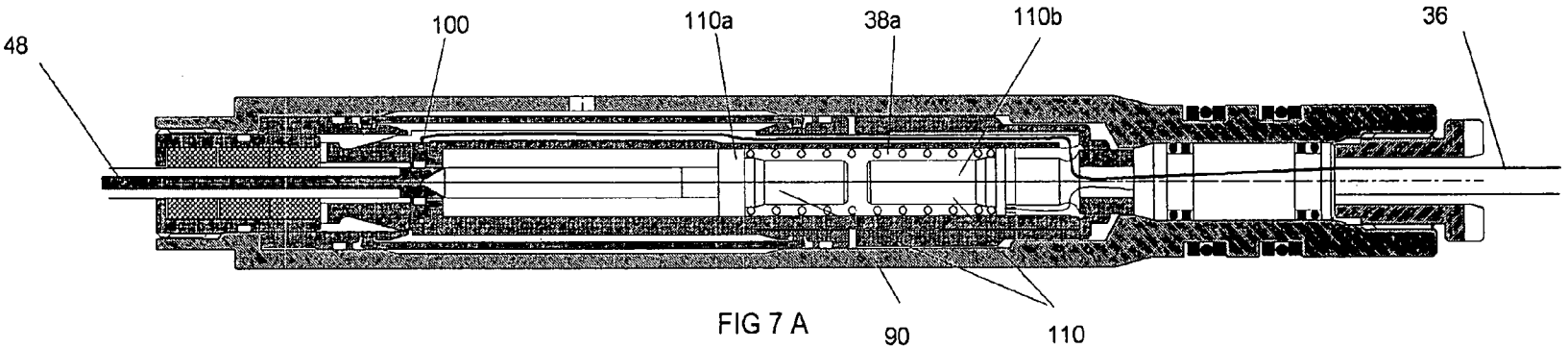
FIG 7 A
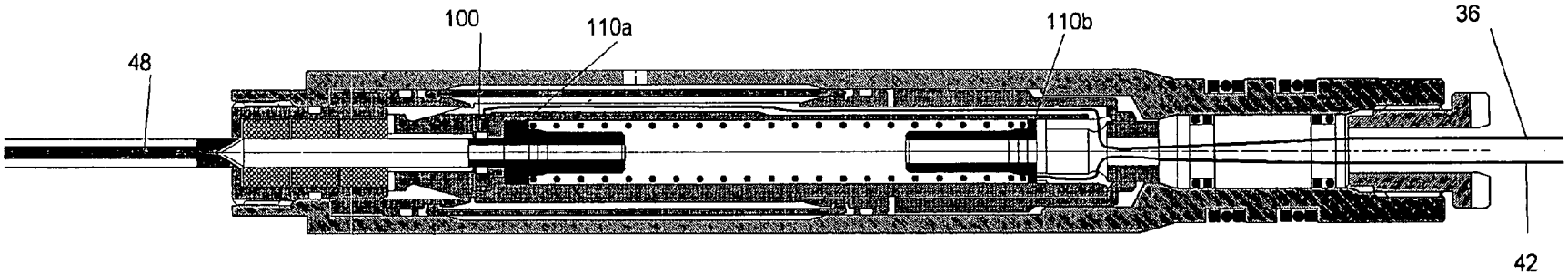
FIG 7 B
FIGURE 7

SUB SEA CONTROL AND MONITORING SYSTEM

FIELD OF THE INVENTION

The present invention relates to sub-sea control and monitoring, and is concerned particularly with an apparatus and a method for controlling and/or monitoring sub-sea equipment such as is used in a well.

BACKGROUND

Connecting to down-hole installed equipment, such as a pressure sensor and/or a temperature sensor or else to a pump, via a cable such as an electrical cable is now common in the oil business. The use of electric submersible-pump power cables and the attachment of instrumentation cables to down-hole devices have been known for many years, especially on land and in shallow water.

The sub-sea environment (operations where the oil well is effectively constructed with its datum and attached pipe-work at seafloor level) presents special challenges for engineers. A sub-sea operation that could straightforwardly be undertaken on dry land has to be undertaken with specialist equipment that has failsafe modes and appropriate margins for failure of equipment. Even with the use of divers and ROVs (remotely operated vehicles), certain operations cannot be undertaken at sea floor level.

During well construction, water depth usually precludes the use of fixed work platforms secured to the seabed. Instead, semi-floating work platforms (semi-submersible rigs) are floated out to the work area and either secured by chains or kept on station by satellite co-ordinated thrusters (i.e. the platforms are dynamically positioned).

Since the well equipment is located on the seabed, whilst being suspended from the semi-floating platform, it is difficult to attach cables to the equipment. There is also a risk that any electrical cable or delicate equipment could easily be damaged during the installation procedure.

Over the years the number of pockets of known hydrocarbon deposits that are accessible by land has diminished, and even those deposits that are accessible within shallow water are becoming scarce. Consequently, operators are moving into ever greater water depths to access oil reserves. This has led to a requirement for more complex, time consuming and costly operations to access and produce oil in deep water. At the same time, the necessary technology to monitor down-hole conditions has become more freely available. What was originally all mechanical equipment is now frequently being replaced by a combination of mechanical and sophisticated electronic monitoring equipment to optimise and monitor well conditions. Whilst the technology to develop electronic sensors and equipment robust enough to work in the harsh sub-sea environment is now available, the methods of connecting and switching the signals are still under development.

As outlined above, there is a drive towards drilling in deeper, more remote waters and to monitor well conditions and performance in order to optimise return on investment. This has led to a review of operations previously considered as routine in order to save the significant increased costs of these operations or the cost of their failure in the deepwater environment. For example, the operation of installing tubular production strings (conduits for the oil) and connecting a permanent monitoring cable to a down-hole device might now take much longer on deep sub-sea wells. Previously, if the equipment was installed without cable or sensor monitoring and it was found to have failed, the equipment would be pulled back out (a so-called "work over") and the damaged item repaired. However, in the deepwater environment, these work over (repair) costs are becoming prohibitively high.

One method for monitoring and therefore controlling the well after installation requires the use of a down-hole pressure and temperature transducer (DHPTT). This is a package that is located on the lowermost end of the production tubing (string) to give a continuous read-out of well pressure and temperature. Through the acquisition of temperature and pressure information from multiple wells, an operator can control a number of wells located in the same reservoir. FIG. 1 shows a typical sub sea layout with multiple well/drill centres.

The following is a description of a typical prior art "running" (i.e. installation) procedure.

FIGS. 2*a* to 2*e* show, schematically, the various stages of running culminating in a completed installation in which the well is being permanently monitored according to a previously considered method.

In FIG. 2*a* the well has been constructed with the wellhead 10 prominent above the seabed 12. It has been installed with a mechanical actuator 14, attached on the side of the wellhead 10, which will subsequently be used to make an electrical connection to a down-hole cable (not shown) inside the well head by penetrating through the wellhead to accommodate an electrical "wet mate" connector in a radial direction through the side of the well head. This procedure is described in detail in U.S. Pat. No. 5,558,532 (Hopper). A signal cable 16 leads from the mechanical actuator 14 to a dynamically positioned floating semi-submersible platform 18 on the surface for eventual monitoring of a down-hole device after installation.

In FIG. 2*b*, which depicts the next stage of the process, a tubular string 20 is lowered through the floating semi-submersible platform in short screwed-together sections. Any electronic sensors or devices are conveyed to the seabed well on this tubular string. A down-hole monitoring cable (not shown in the figure) is attached to the devices and is located within the tubular string as the assembly is lowered to the seabed. Once the calculated length of tubes is installed to fit the well depth, a 'tubing hanger' 22 is attached to the tubes to allow the installation to hang from a profile 26 in the sea bed known in the industry, on account of its shape, as a "Christmas tree" (a steel housing that remains at the well head and allows tubes to hang and valves to be attached). The tubing hanger 22 and tubing 20 are conveyed to the "tree" at sea floor by a releasable latch known as a tubing hanger running tool 24. This is attached to a profile in the tubing hanger 22 and the entire assembly (string) is then conveyed to the sea floor by adding lengths of screwed tubing until the tubing hanger reaches and engages the tree. This is a standard procedure.

FIG. 2*c* shows the running tool after it has just been disconnected. The running tubes can now be retrieved to the surface.

FIG. 2*d* depicts a remote-operated vehicle (ROV) 28 mechanically turning the actuator 14 that pushes forward the wet mate horizontal connector to make a permanent connection to the down-hole devices via the down-hole cable.

FIG. 2*e* shows the final configuration when the well is complete and the permanent monitoring cable 16 is commissioned to a final vessel or semi-floating work platform.

In view of the high costs of repair work in the deep sea environment, as outlined earlier, there is a strong incentive to monitor equipment to check that it is functioning during installation, in order to avoid the need for a costly work over. Thus, a device that is developed as part of the installed sub sea well head that allows electrical signals to be switched from monitoring whilst running (i.e. whilst installing) to permanent monitoring (i.e. after installation) is desirable, especially in the arduous sub sea environment.

One disadvantage of the prior system, as outlined above with reference to FIG. 2, is that the process does not permit monitoring of the down-hole device during installation (running).

SUMMARY

The present invention is defined in the attached independent claims, to which reference should now be made. Further, preferred features may be found in the sub-claims appended thereto.

In one aspect, the invention provides a system for monitoring and/or controlling at least one device mounted on a tubing string of a well, the system comprising: a down-well cable for conveying a signal to and/or from at least one device mounted on a tubing string of a well; a temporary surface cable for conveying a signal between the at least one device and a first monitor/control station prior to and/or during installation of a tubing string in a well; a permanent surface cable for conveying a signal between the at least one device and a second monitor/control station after installation of the tubing string in a well; and switch means configurable between a first configuration, in which the down-well cable and the temporary cable are connected, and a second configuration, in which the down-well cable and the permanent cable are connectable.

The invention also provides switch means for use in switching a signal from at least one device mounted on a tubing string of a well, the switch means being configurable between a first configuration, in which a down-well cable, for conveying a signal from/to at least one device mounted on a tubing string of a well, and a temporary surface cable for conveying a signal between the at least one device and a first monitor/control station prior to and/or during installation of a tubing string in a well are connected, and a second configuration, in which the down-well cable and a permanent surface cable for conveying a signal between the at least one device and a second monitor/control station after installation of the tubing string in a well are connectable.

The invention also provides a method of monitoring and/or controlling at least one device mounted on a tubing string of a well, the method comprising: monitoring and/or controlling said device via a temporary surface cable connected to a down-well cable and arranged to convey a signal between the at least one device and a first monitor/control station prior to and/or during installation of the tubing string in the well, in a first configuration; monitoring and/or controlling said device via a permanent surface cable connected to the down-well cable and arranged to convey a signal between the at least one device and a second monitor/control station after installation of the tubing string in a well, in a second configuration; and switching between the first and second configurations.

The invention also provides a system for monitoring and/or controlling at least one device mounted on a tubing string of a well, the system comprising: a down-well cable for conveying a signal to and/or from at least one device mounted on a tubing string of a well; a temporary surface cable for conveying a signal between the at least one device and a first monitor/control station prior to and/or during installation of a tubing string in a well; and switch means configurable between a first configuration, in which the down-well cable and the temporary cable are connected, and a second configuration, in which the down-well cable and the temporary cable are not connected.

The invention also includes any combination of the features or limitations referred to herein, except combinations of such features as are mutually exclusive.

BRIEF DESCRIPTION OF THE DRAWINGS

FIGS. 7*a* and 7*b* show one example of the construction of a switching means suitable for use in the above-described embodiments.

DETAILED DESCRIPTION

Figure 1:
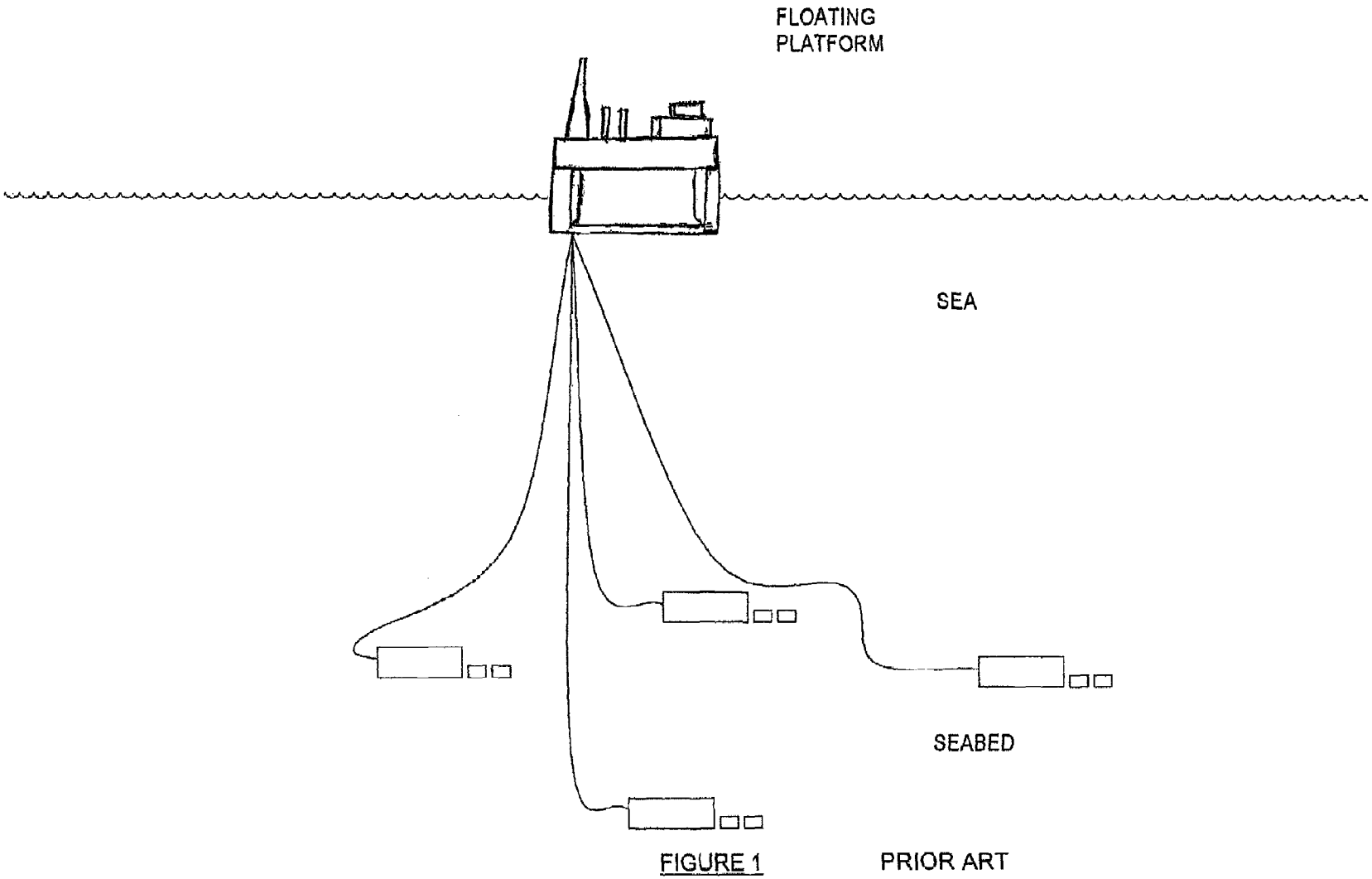
PRIOR ART FIGURE 1
FIG. 1 shows schematically a modern sub-sea oilfield comprising a number of wells with monitoring cables connected to a floating station.
Figure 2:
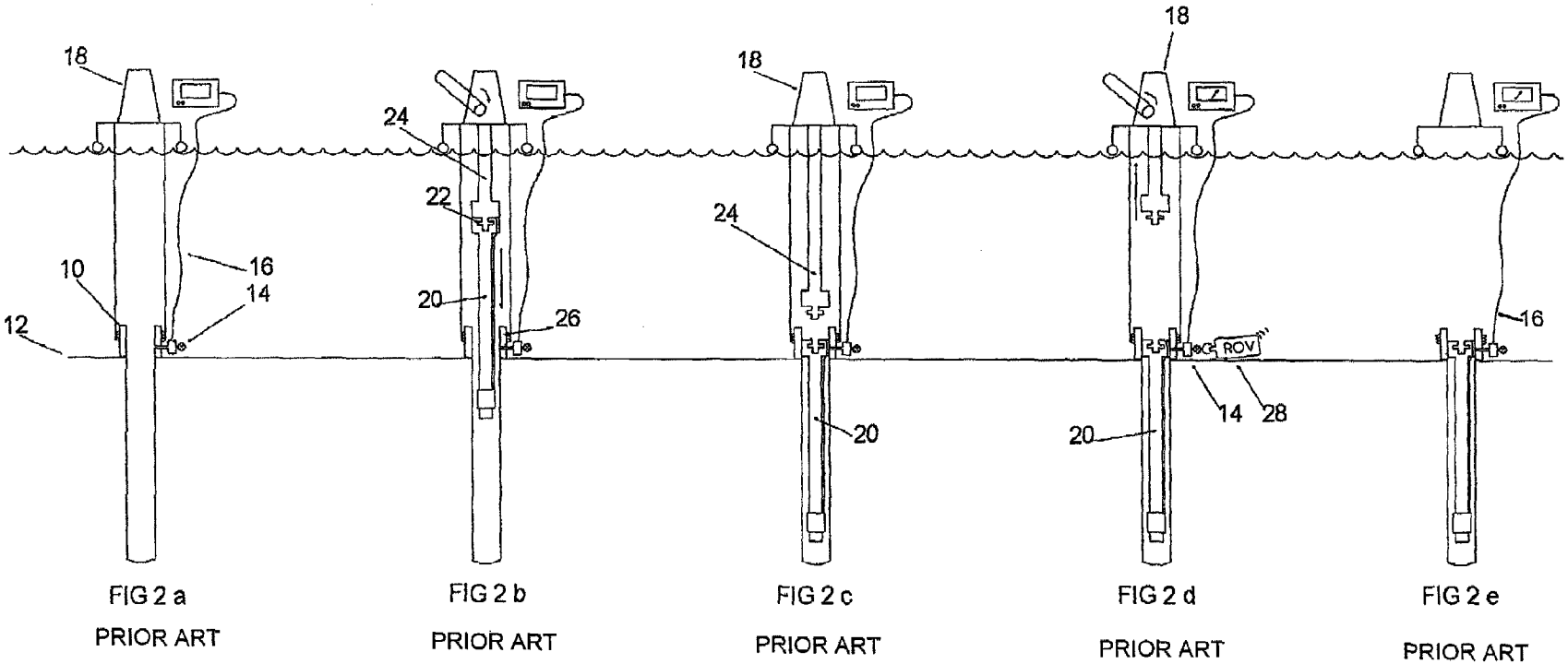
FIGS. 2*a* to 2*e* show schematically a series of steps for installing a tubing string in a sub-sea well and monitoring signals from sensors on the string, according to a prior art method.
Figure 3:
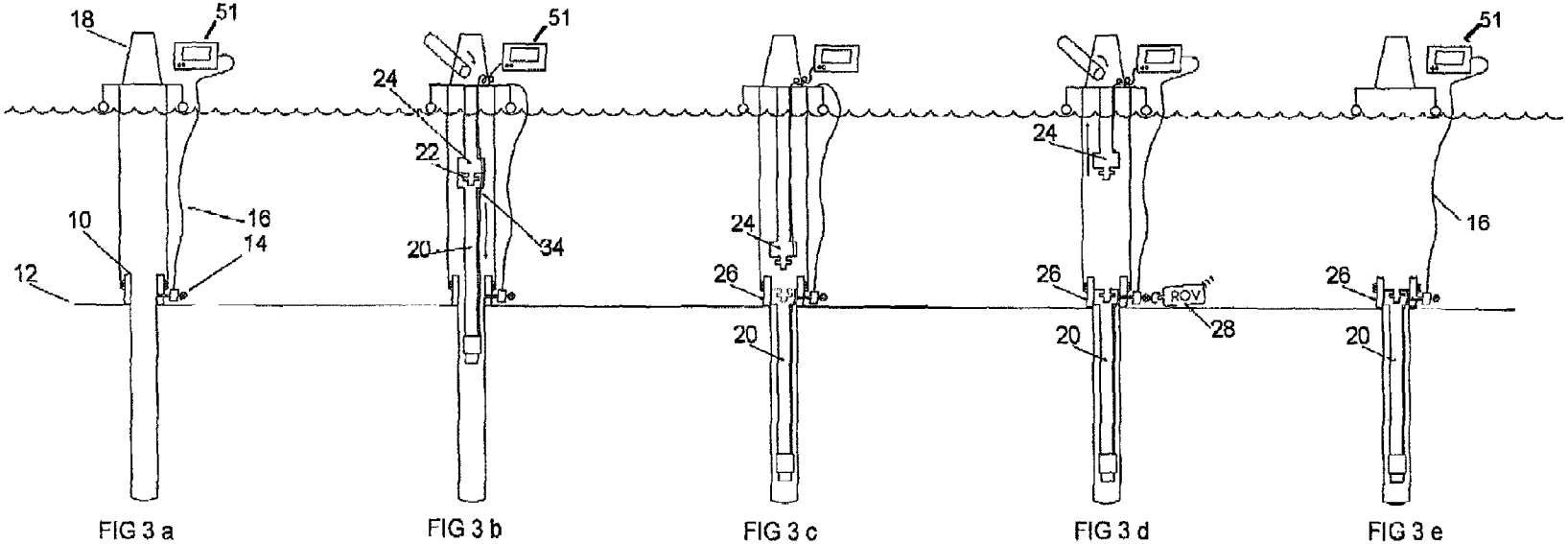
FIGS. 3*a* to 3*e* show schematically a series of steps for installing a tubing string in a sub-sea well and monitoring signals from sensors on the string, according to a preferred embodiment of the present invention.

Turning now to FIGS. 3*a* to 3*e*, these show schematically the various stages of running culminating in a completed installation in which the well is being permanently monitored in accordance with a preferred embodiment of the present invention. Where possible, features common with the prior art example of FIGS. 2*a* to 2*e* have been given the same reference numbers.

In FIG. 3*a*, as before, the well has been constructed with the wellhead 10 prominent above the seabed 12. It has been installed with a mechanical actuator 14, attached on the side of the wellhead 10, which will subsequently be used to make an electrical connection to a down-hole cable (not shown) inside the well head by penetrating through the wellhead to accommodate an electrical "wet mate" connector in a radial direction through the side of the well head. A permanent cable 16 leads from the mechanical actuator 14 to a dynamically positioned floating semi-submersible platform 18 on the surface for use in monitoring a down-well device permanently after installation. The permanent cable 16 is a surface cable in that it is above the well. It could, of course, lead to a monitoring station below the surface of the sea.

In FIG. 3*b*, which depicts the next stage of the process, a tubular string 20 is lowered through the floating semi-submersible platform 18 in short screwed-together sections. Any electronic sensors or devices are conveyed to the seabed well on this tubular string 20. A down-hole monitoring cable (not shown in the figure) is attached to the devices and is located within the tubular string 20 as the assembly is lowered to the seabed. Once the calculated length of tubes is installed to fit the well depth, a tubing hanger 22 is attached to the tubes to allow the installation to hang from a tree profile 26 in the sea. The tubing hanger 22 and tubing 20 are conveyed to the "tree "at sea floor by a releasable latch known as a tubing hanger running tool 24. This is attached to a profile in the tubing hanger 22 and the entire assembly (string) is then conveyed to the sea floor by adding lengths of screwed tubing until the tubing hanger 22 reaches and engages the tree 26.

In contrast with the prior art, the present invention makes possible the monitoring of the equipment during running. To achieve this, the tubing hanger 22 contains through bores that accommodate a vertical electrical connector that is connected to a temporary monitoring cable 34 for monitoring via a monitor 51 the down-well device during (installation) running. The monitoring cable 34 is attached via clamps (not shown) adjacent to the running tool tubing all the way to the surface.

FIG. 3*c* shows the running tool 24 after it has just been disconnected. The running tubes and temporary monitoring cable 34 can now be retrieved to surface.

By use of switch means described in detail with reference to FIGS. 4 to 7, the connection between the temporary monitoring cable 34 and the down-well cable (not shown) has been opened, whilst a new connection between the down-well cable and the permanent monitoring cable 16 has been prepared, awaiting only actuation of the wet-mate connector by the actuator 14.

FIG. 3*d* depicts a remote-operated vehicle (ROV) 28 mechanically turning the actuator that pushes forward the wet mate horizontal connector to make a permanent connection to the down-hole devices via the down-hole cable.

FIG. 3*e* shows the final configuration when the well is complete and the permanent monitoring cable 16 is commissioned to a final vessel or semi-floating work platform.

FIGS. 4 to 7 will now be referred to as embodiments of the invention are described in more detail.

Figure 4A:
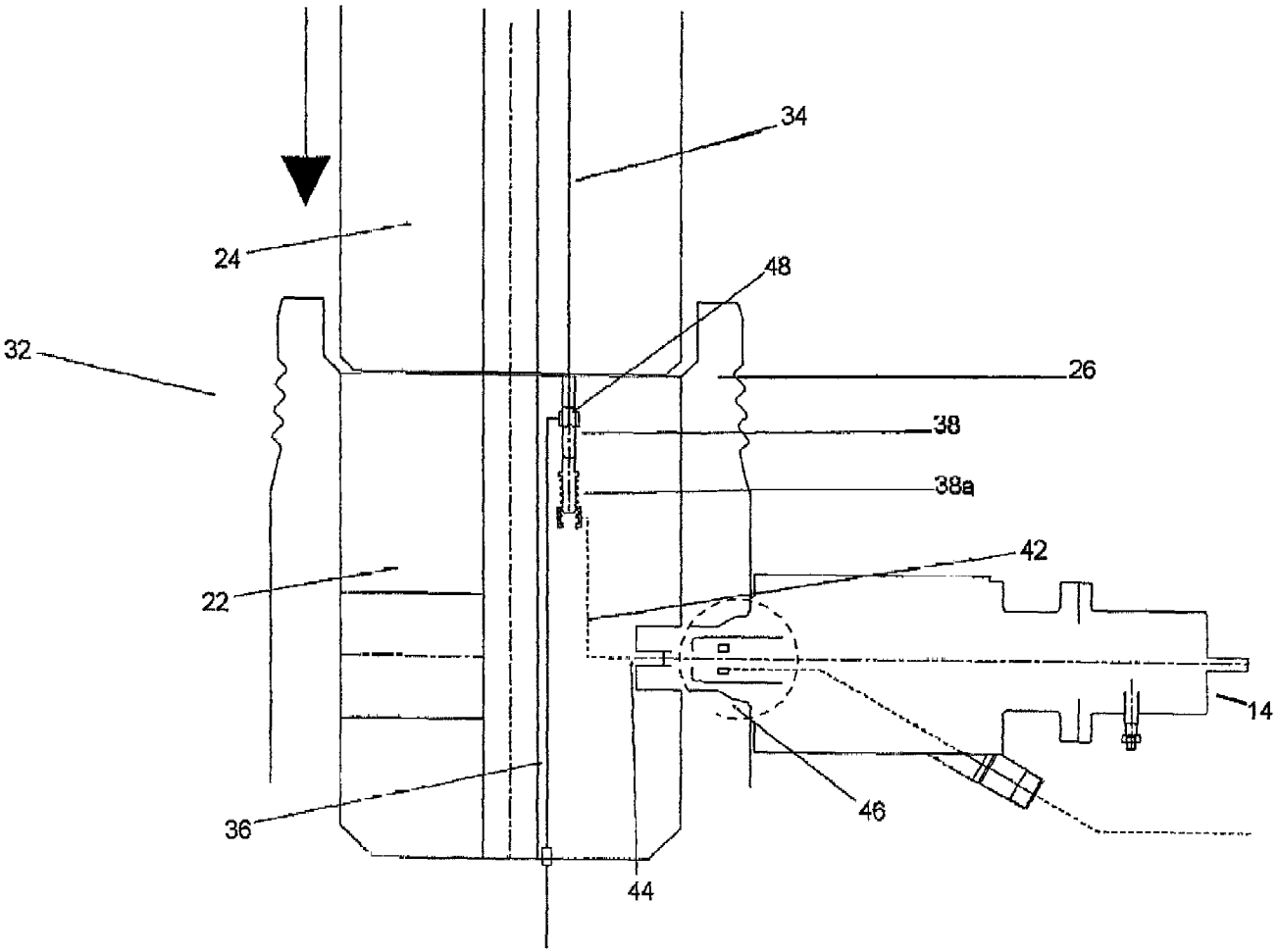
FIG. 4*a* shows schematically switching means in a first configuration, according to a first embodiment of the present invention.

Referring now to FIG. 4*a*, this shows generally a well head 32 during installation of a tubing hanger 22. The tubing hanger 22 is still attached to the tubing hanger running tool 24 and has engaged the tree 26. A temporary monitoring cable 34 extends upwards through the tubing hanger running tool 24 to monitoring apparatus (51 in FIG. 3*b*) located at the surface (not shown). A down-well monitoring cable 36 extends downwards inside the tubing hanger 22 through the tubing string (not shown) to down-well sensor equipment. The temporary cable 34 and the down well cable 36 are connected by a spring-loaded switch 38. To the side of the tree 26 is a wet mate connector 40 having a mechanical actuator 14. Inside the tubing hanger 22 and connected to an unused contact of the switch 38 is a short cable portion 42 shown in broken lines. The short cable portion leads from the switch to a horizontal wet mate pin 44 which is arranged in use to engage and make electrical contact with a female wet mate connector portion 46 upon actuation by the mechanical actuator 14.

The switch 38 comprises a first contact position in which the down-well monitoring cable 36 is in electrical contact with the temporary monitoring cable 34, and a second contact position in which the down-well monitoring cable is in electrical contact with the short cable portion 42. A compression spring 38*a* is located within the switch 38 between the first and second contact positions. In the configuration shown in FIG. 3*a* the presence of the tubing hanger running tool 24 in engagement with the tubing hanger 22 biases the switch 38 in the position shown by means of a switch pin 48 (shown more clearly in FIG. 4*b*) compressing the switch spring 38*a*.

Figure 4B:
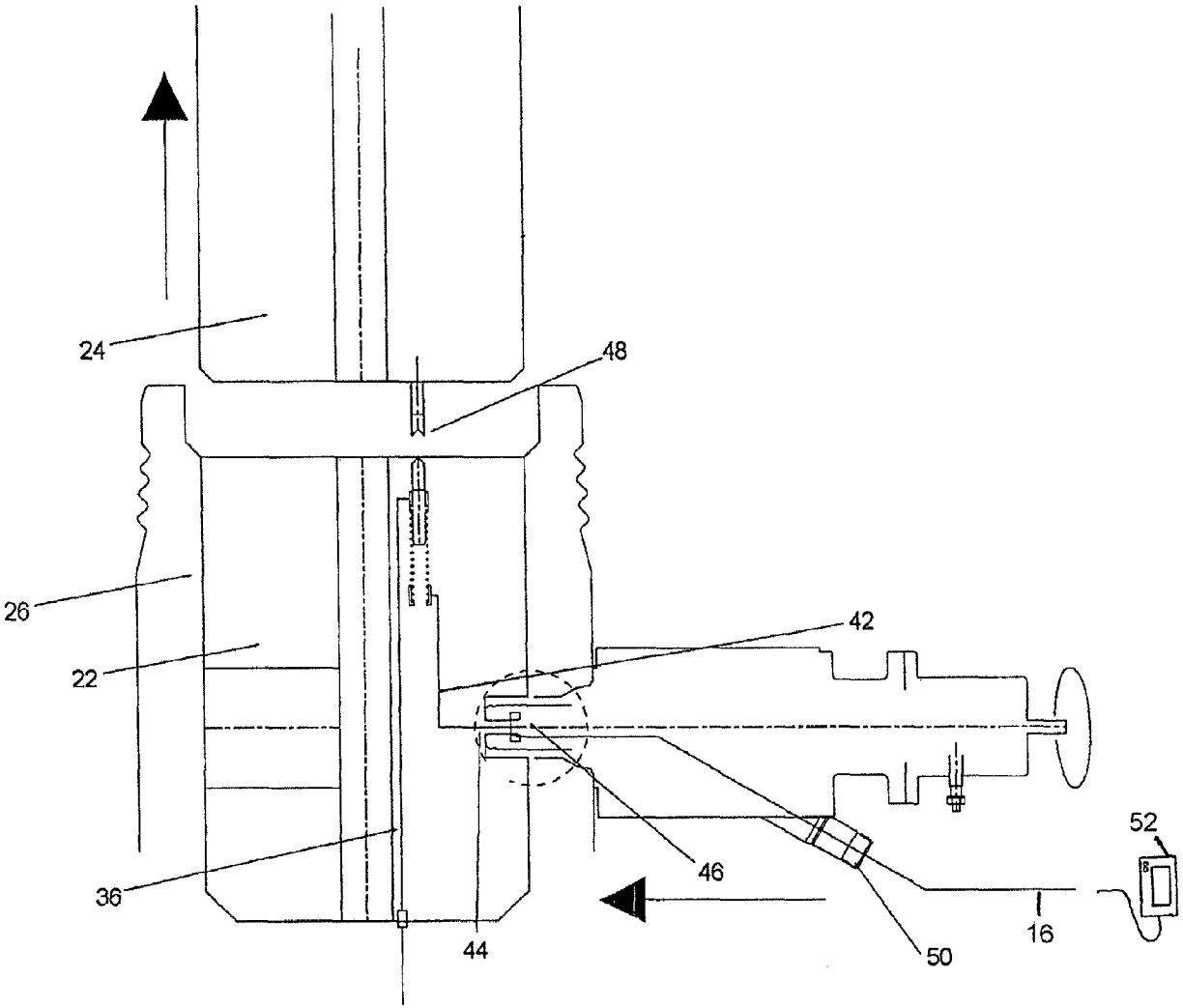
FIG. 4*b* shows schematically the switching means of FIG. 4*a* in a second configuration.

FIG. 4*b* shows the well head immediately after the tubing hanger running tool 24 has disengaged from the tubing hanger 22. Upon withdrawal of the switch pin 48 the compression spring 38*a* biases the switch 38 in the second configuration (shown) in which the down-well monitoring cable 36 is no longer connected to the temporary monitoring cable 34 but is now connected to the short cable portion 42. In this figure the mechanical actuator 14 has also been operated to cause the female wet mate connector 46 to make electrical contact with the horizontal wet mate pin 44, thereby allowing monitoring signals from the down-well cable 36 to be taken out of a permanent monitoring connection 50, which is connected via a permanent monitoring cable 16 to a permanent monitoring station 52 in FIG. 4B on the surface or on land.

If the tubing hanger running tool 24 is reconnected to the tubing hanger 22, the switch pin 48 will cause the switch 38 to become biased in the first configuration, with the down-well monitoring cable becoming reconnected to the temporary monitoring cable 34 in the tubing hanger running tool. The process can be repeated as often as necessary and each time the reversible connections will be made reliably and cleanly.

Figure 5A:
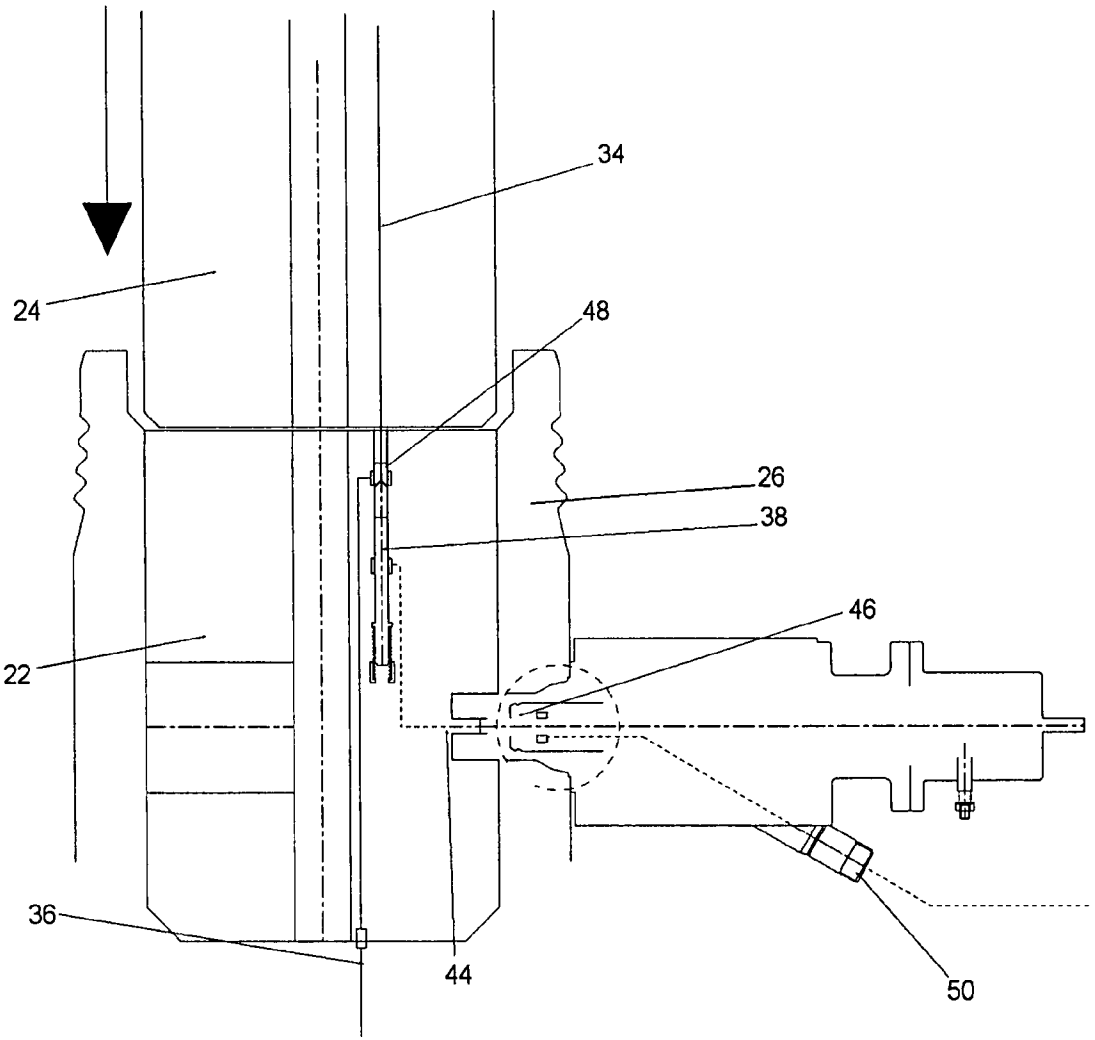
FIG. 5*a* shows schematically switching means in a first configuration, according to a second embodiment of the present invention.
Figure 5B:
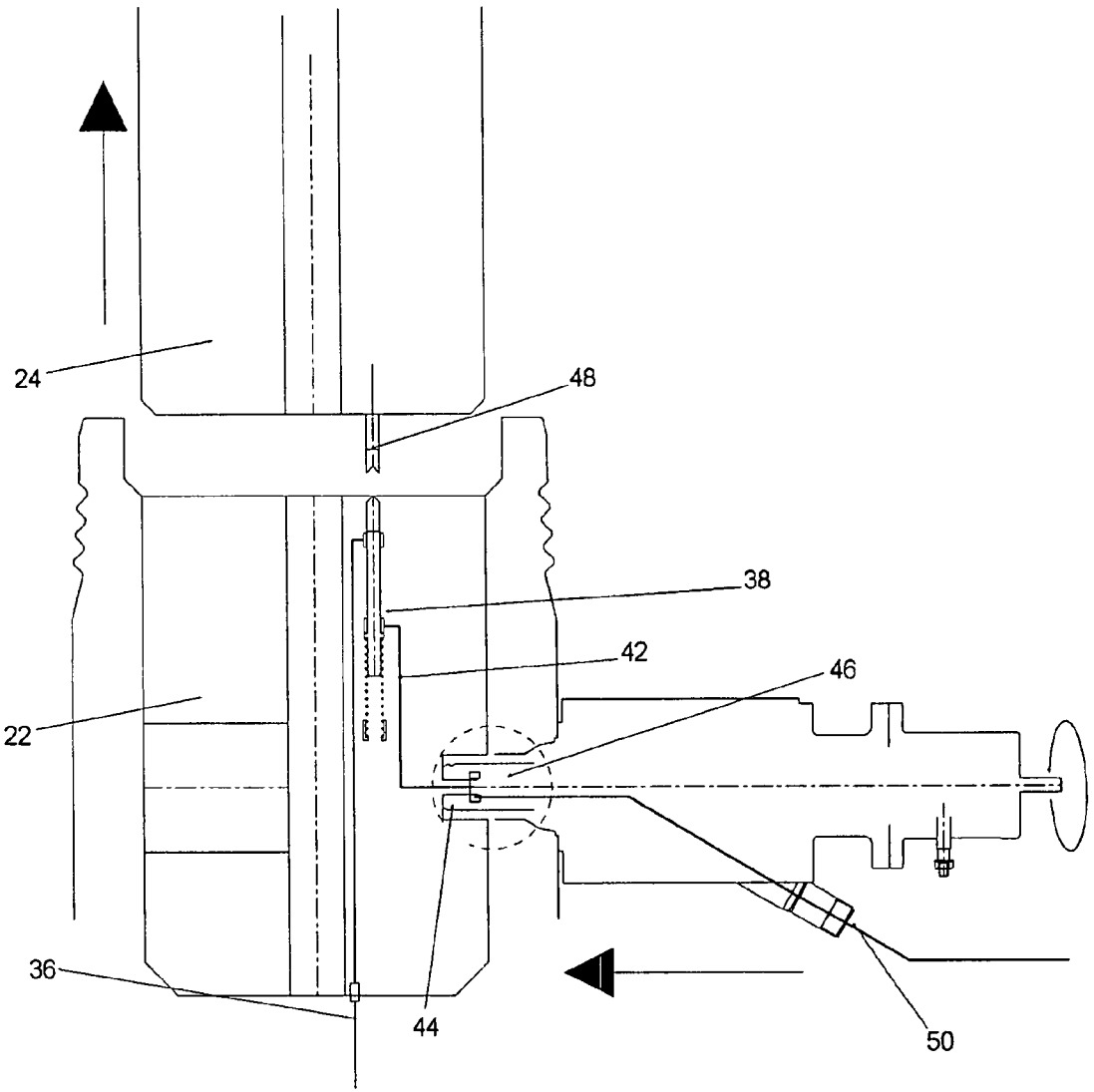
FIG. 5*b* shows schematically the switching means of FIG. 5*a* in a second configuration.

FIGS. 5*a* and 5*b* correspond to FIGS. 4*a* and 4*b* respectively, but in this case the biasing spring 38*a* is at a location spaced from the switching contacts.

Figure 6A:
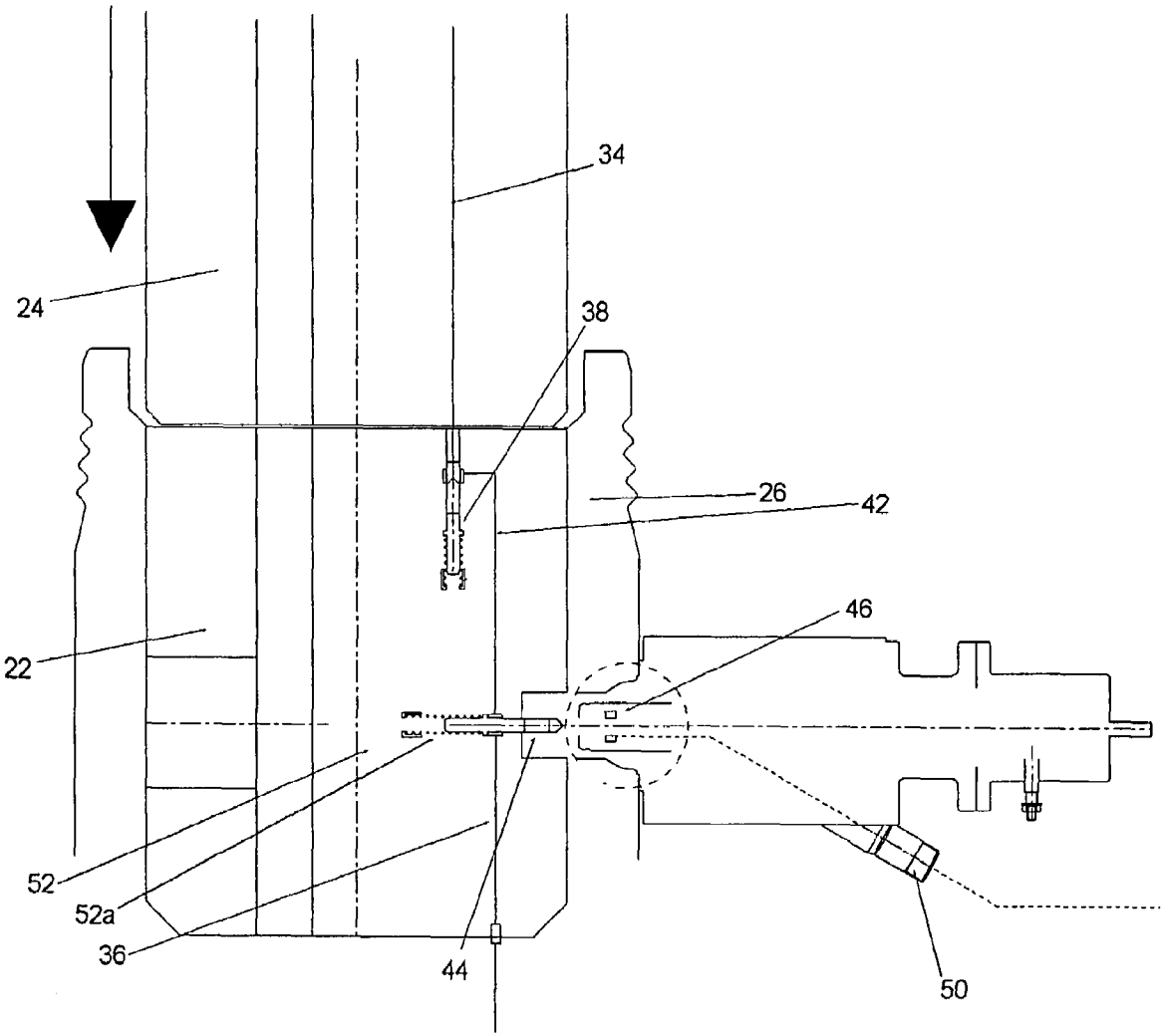
FIG. 6*a* shows schematically switching means in a first configuration according to a third embodiment of the present invention.
Figure 6B:
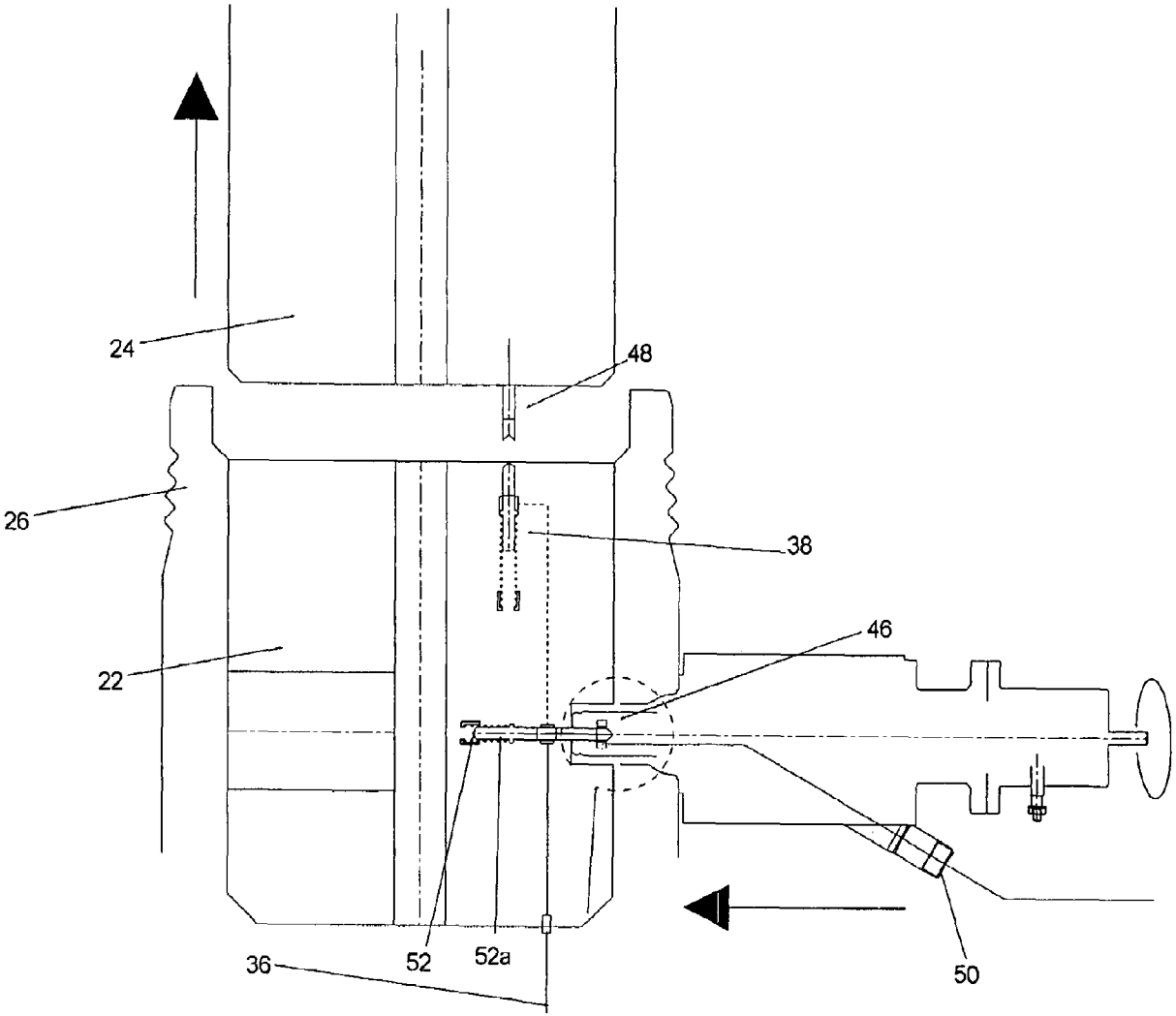
FIG. 6*b* shows schematically the switching means of FIG. 6*a* in a second configuration.

Similarly, FIGS. 6*a* and 6*b* correspond to FIGS. 4*a* and 4*b*, but in the embodiment shown in FIGS. 6*a* and 6*b* there is a second spring-loaded switch 52 which is moveable between the position shown in FIG. 5*a*, in which the wet mate connector has not yet been actuated and the switch 52 is biased by a compression spring 52*a* to connect the down-well monitoring cable via the short cable portion 42 to the temporary monitoring cable, and a second position shown in FIG. 5*b* in which the wet mate connector has been actuated and the switch 52 connects the down-well monitoring cable to the permanent monitoring cable 50.

In a further embodiment, which may utilize the switch means of any of FIGS. 4 to 6, the switch pin 48 is retractable into the tubing hanger running tool 24. Thus, in this embodiment, when the tubing hanger running tool 24 is connected to the tubing hanger 22, the switch pin 48 will normally cause the switch 38 to become biased in the first configuration, with the down-well monitoring cable 36 being connected to the temporary monitoring cable 34 in the tubing hanger running tool. When the switch pin 48 is retracted inside the tubing hanger running tool 24, however, the compression spring 38*a* biases the switch 38 in the second configuration (shown) in which the down-well monitoring cable 36 is no longer connected to the temporary monitoring cable. In this way, switching between the first and second configurations can be performed without needing to disengage the tubing hanger running tool from the tubing hanger. Advantageously, this enables the temporary monitoring cable 34 to be disconnected from the down-well monitoring cable 36 before the tubing hanger has engaged with the tree 26. Then, by electrically isolating the retracted switch pin, electrical testing can be performed on the temporary monitoring cable. In this way, if a fault develops before the tubing hanger has reached the sea bed, testing can be performed to determine if the fault is in the temporary monitoring cable or in the permanently installed equipment.

FIGS. 7*a* and 7*b* show one example of the construction of a switching means suitable for use in the above described embodiments.

The switching means comprises the spring-loaded switch 38 having a housing 90 in which is contained a contact ring 100, the compression spring 38*a* and a shuttle body 110 having two parts 110*a* and 110*b*, each connected to one end of the compression spring. The down-hole monitoring cable 36 is permanently connected to the contact ring 100. In FIG. 7*a*, the switch is in the first contact position, in which the switch pin 48 provided at the end of the temporary monitoring cable 34 is in contact with the contact ring 100. In this first configuration, the compression spring is biased in a compressed state.

In FIG. 7*b*, the tubing hangar running tool has been disengaged from the tubing hangar, or the switch pin has been retracted into the tubing hanger running tool, such that the switch pin 48 of the temporary monitoring cable 34 has become disconnected from the contact ring 100. The compression spring 38*a* now biases the switch 38 in the second configuration, in which the shuttle body 110*a* makes contact with the contact ring 100. This completes the circuit across the switch 38, through the shuttle body part 110*a*, the spring 38*a* and the shuttle body part 110*b*, such that the down-hole monitoring cable 36 is now electrically connected to the short cable portion 42 leading to the permanent monitoring connection 50.

There are various other means (not shown) of switching in this environment and location. It is possible to use a diode to isolate each line electronically without using a mechanical device. However, due to the electrical properties of a diode in the reverse direction, the current that passes through the diode in the reverse direction may be too great for satisfactory performance and integrity testing when the current and voltage are low (instrumentation level installation). The switching could be achieved by the use of a solenoid. Alternatively, the switching could be achieved via a contact-less method where no horizontal actuator was needed through the use of magnetic induction or other matching sensors that line up and transfer the current.

An ROV (remotely operated vehicle) or a diver can rotate the mechanical actuator so as to extend the female wet mate connector horizontally to connect to the horizontal male wet mate connector. This connects the electrical signal to the permanently installed monitoring line.

One advantage of the system outlined above with reference to FIGS. 3 to 7 is that the process is reversible i.e. even after the temporary monitoring cable 34 on the tubing hanger running tool has been disconnected from the down-hole cable in the tubing hanger it remains possible to re-connect it. Reconnection might be desirable if, for example, a fault were to be detected during permanent—i.e. post-installation—monitoring. In such a case, being able to lower the tubing hanger running tool and re-connect the temporary monitoring cable to the down-well cable might allow an operative to determine whether the fault is with the down-well sensors or else with the wet-mate connector, or even with the permanent monitoring cable itself. During installation ("running") it is not uncommon for the tubing hanger running tool to be disconnected and reconnected several times if problems are encountered in engaging the tubing hanger with the tree or if unsatisfactory or puzzling readings are detected. In such cases the ability to disconnect and reconnect the temporary monitoring cable provides an advantage.

Furthermore, switching may be performed by retracting the switch pin into the tubing hanger running tool, without needing to disconnect the tubing hanger running tool from the tubing hanger. In this way, testing can be performed before the tubing hanger has engaged with the tree.

Reversible switching of an electrical signal in the complex, permanently installed well head hanger has previously not been undertaken and has the potential to save sub sea well operators significant amounts of time by avoiding remedial work. The integrity of the cables and the functioning of the down-hole devices can now be monitored throughout installation and thereafter with immediate feedback, and the operator has the option of reconnecting to a temporary monitoring cable by reconnecting the tubing hanger running tool.

Whereas the specification speaks mainly of using electrical cables and electrical switch means to monitor and/or control down-well devices, it will be understood that the invention is equally applicable to the use of optical cables and electrical switches.

Also, whilst the embodiments described are concerned with sub sea oil wells, it will be understood that the invention is equally applicable to other kinds of wells such a gas wells.

Although the invention has been described with respect to specific embodiments for a complete and clear disclosure, the appended claims are not to be thus limited but are to be construed as embodying suitable modifications and equivalents that may occur to one skilled in the art and which fairly fall within the basic teaching herein set forth.

What is claimed is:

1. A system for monitoring or controlling at least one device mounted on a tubing string of a subsea well, the system comprising:

a down-well cable for conveying a signal to or from at least one device mounted on the tubing string of the subsea well;

a temporary surface cable for conveying a signal between the at least one device and a first monitor or control station prior to or during installation of the tubing string in the subsea well;

a permanent surface cable for conveying a signal between the at least one device and a second monitor/control station after installation of the tubing string in the sub-data well; and switch means configurable between a first configuration, in which the down-well cable and the temporary cable are connected, and a second configuration, in which the down-well cable and the permanent cable are connectable.

2. A system according to claim 1 wherein, in the first configuration of the switch means the down-well cable and the permanent cable are not connected, and in the second configuration of the switch means the down-well cable and the temporary cable are not connected.

3. A system according to claim 2 wherein, prior to or during installation, the switch means is configurable in the second configuration such that the down-well cable and the temporary cable are not connected, so as to allow testing of the temporary cable to be performed.

4. A system according to claim 1 wherein in the second configuration, the permanent cable is connected to the down-well cable by a wet-mate-type connector.

5. A system according to claim 1 wherein the switch means is made to adopt the first configuration by engagement of an installation tool with tubing during installation of the tubing in the well.

6. A system according to claim 1 wherein the switch means is made to adopt the second configuration by disengagement of an installation tool from tubing immediately after installation of the tubing in the well.

7. A system according to claim 5 wherein the switch means is located in a tubing hanger, from which a tubing string is arranged to hang, and the installation tool is a tubing hanger running tool which is arranged to engage the tubing hanger during installation of the tubing hanger, at which time the switch means is made to adopt the first configuration, and which tubing hanger running tool is arranged to be disengaged from the tubing hanger immediately after installation of the tubing hanger, at which time the switch means is made to adopt the second configuration.

8. A system according to claim 1 wherein the switch means is made to adopt the second configuration by retraction of a switch member from the switch means into an installation tool used to install a tubing string in the well.

9. A system according to claim 8, wherein the switch means is located in a tubing hanger, from which the tubing string is arranged to hang, and the installation tool is a tubing hanger running tool which is arranged to engage the tubing hanger during installation of the tubing hanger, at which time the switch means is made to adopt the first configuration, wherein the switch means can be made to adopt the second configuration by retraction of the switch member from the switch means into the tubing hanger running tool.

10. A system according to claim 1 wherein the switch means comprises a mechanically operable switch.

11. A system according to claim 1 wherein the switch means comprises an electrically or electronically or optically operable switch.

12. A system according to claim 1 wherein the first and second monitor/control stations comprise the same monitor/control station.

13. Switch means for use in switching a signal from at least one device mounted on a tubing string of a subsea well, the switch means being configurable between a first configuration, in which a down-well cable, for conveying a signal from or to at least one device mounted on the tubing string of a well, and a temporary surface cable for conveying a signal between the at least one device and a first monitor/control station prior to or during installation of the tubing string in the subsea well are connected, and a second configuration, in which the down-well cable and a permanent surface cable for conveying a signal between the at least one device and a second monitor/control station after installation of the tubing string in the subsea well are connectable.

14. Switch means according to claim 13 wherein the switch means comprises a mechanically operable switch.

15. Switch means according to claim 13 wherein the switch means comprises an electrically or electronically or optically operable switch.

16. A method of monitoring or controlling at least one device mounted on a tubing string of a subsea well, the method comprising:

monitoring or controlling said device via a temporary surface cable connected to a down-well cable and arranged to convey a signal between the at least one device and a first monitor or control station prior to or during installation of the tubing string in the subsea well, in a first configuration;

monitoring or controlling said device via a permanent surface cable connected to the down-well cable and arranged to convey a signal between the at least one device and a second monitor/control station after installation of the tubing string in the subsea well, in a second configuration;

and switching between the first and second configurations.

* * * * *